US007270590B2

(12) United States Patent
Marine et al.

(10) Patent No.: US 7,270,590 B2
(45) Date of Patent: Sep. 18, 2007

(54) ASSISTED WALKING DOLLS AND JOINT ASSEMBLIES FOR USE WITH SAME

(75) Inventors: Jon C. Marine, Fullerton, CA (US); Joe Carl Ward, La Mirada, CA (US); Elizabeth Libretti, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 101 days.

(21) Appl. No.: 11/060,974

(22) Filed: Feb. 17, 2005

(65) Prior Publication Data

US 2005/0239368 A1 Oct. 27, 2005

Related U.S. Application Data

(60) Provisional application No. 60/546,291, filed on Feb. 19, 2004.

(51) Int. Cl.
*A63H 3/46* (2006.01)

(52) U.S. Cl. ..... 446/377; 446/355; 446/378

(58) Field of Classification Search ..... 446/355, 446/377, 378; 16/229, 328, 351, 374; 403/113, 403/116, 117

See application file for complete search history.

(56) References Cited

U.S. PATENT DOCUMENTS

| | | | | | |
|---|---|---|---|---|---|
| 606,415 | A | * | 6/1898 | Hotaling | 16/351 |
| 1,294,044 | A | * | 2/1919 | Buckwalter et al. | 16/351 |
| 1,329,959 | A | | 2/1920 | Criest | |
| 1,508,013 | A | * | 9/1924 | De Waters | 16/351 |
| 1,526,456 | A | | 2/1925 | Bowie | |
| 3,386,201 | A | | 6/1968 | Kelly et al. | |
| 3,425,154 | A | | 2/1969 | Lindsay et al. | |
| 3,604,147 | A | | 9/1971 | Ceccon | |
| 3,802,706 | A | | 4/1974 | Hamm | |
| 3,837,114 | A | | 9/1974 | Goldfarb et al. | |
| 4,156,985 | A | | 6/1979 | Viner | |
| 4,295,291 | A | | 10/1981 | Fukui | |
| 4,467,555 | A | | 8/1984 | Terzian et al. | |
| 4,790,789 | A | | 12/1988 | Mathis | |
| 4,930,186 | A | * | 6/1990 | Linwu | 16/325 |
| 5,088,954 | A | | 2/1992 | Terzian et al. | |
| 5,224,896 | A | | 7/1993 | Terzian | |
| 5,257,873 | A | | 11/1993 | Abbat | |
| 5,289,616 | A | * | 3/1994 | Taniyama | 16/376 |
| 5,334,354 | A | * | 8/1994 | Johnston et al. | 422/104 |
| 5,713,780 | A | | 2/1998 | Gallagher | |
| 5,873,847 | A | * | 2/1999 | Bennett et al. | 602/16 |
| 6,004,185 | A | | 12/1999 | Rehkemper et al. | |
| 6,018,847 | A | * | 2/2000 | Lu | 16/337 |
| 6,129,690 | A | * | 10/2000 | Hamlin et al. | 602/16 |

* cited by examiner

*Primary Examiner*—John A. Ricci
(74) *Attorney, Agent, or Firm*—Kolisch Hartwell, P.C.

(57) ABSTRACT

A toy doll may include a body supported by a skeletal structure including one or more joint assemblies. A joint assembly may include a pivot block further including a pivot stop, and a joint member rotatably coupled to the pivot block, the joint member further including a stop protrusion configured to engage the pivot stop upon rotation of the joint member in a predetermined direction, wherein engagement of the pivot stop prevents further rotation of the joint member in a predetermined direction, wherein the joint member is moveable through a predetermined range of motion transverse to the plane of rotation of the joint member, and wherein movement of the joint member transverse to the plane of rotation allows the stop protrusion to bypass the pivot stop.

6 Claims, 4 Drawing Sheets

ASSISTED WALKING DOLLS AND JOINT ASSEMBLIES FOR USE WITH SAME

RELATED APPLICATION(S)

This application is based upon and claims priority under 35 U.S.C. § 119(e) to the U.S. Provisional Patent Application No. 60/546,291, entitled "Assisted Walking Doll" and filed on Feb. 19, 2004, the disclosure of which is incorporated herein by reference in its entirety for all purposes.

TECHNICAL FIELD

The present disclosure relates generally to toy dolls, and more specifically to assisted walking dolls and joint assemblies for use with same.

BACKGROUND

Toy dolls are popular among children. A toy doll that simulates walking increases the play value of such a toy doll. Examples of various walking toy dolls are found in U.S. Pat. Nos. 1,526,456; 3,386,201; and 3,837,114. Examples of toy walking dolls with legs configured to provide skid resistance with respect to a support surface are found in U.S. Pat. Nos. 5,713,780 and 6,004,185. The disclosures of the aforementioned references are incorporated herein by reference in their entirety for all purposes.

SUMMARY

The present disclosure provides an assisted walking doll having a body with a head, torso, arms, legs, and feet. The body may be supported by a skeletal structure having a torso housing, joint members such as arm members and leg members, and joint assemblies rotatably coupling the joint members to the torso housing. Joint assemblies may thus include shoulder-joint assemblies and hip-joint assemblies.

A joint assembly may include a pivot block on the torso housing, configured to support a joint member via a rotatable pivot rod, and may also include a pivot stop extending from the pivot block. The supported joint member may include a stop protrusion extending therefrom, which may be configured to engage the pivot stop, such as to selectively prevent rotation of the joint member in a predetermined direction or beyond a predetermined range of rotation. Thus, in some embodiments, the arm members of a doll may thus be selectively prevented from being rotated upward beyond a predetermined orientation such that further upward force applied to the arms, such as by a user, may move the doll from a seated position to a standing position, and then move the doll in a simulated walking motion.

In some embodiments, a joint member may be configured to be moveable through a predetermined range of motion transverse to the plane of rotation of the joint member. In such embodiments, movement of the joint member transverse to the plane of rotation allows the stop protrusion to bypass the pivot stop. Thus, in some embodiments, the arm members of a doll may be angled inward to bypass the pivot stop and then rotated fully upwards. Such embodiments may provide additional play patterns in which the doll may be moved in a simulated walking motion.

DETAILED DESCRIPTION

Figure 1:
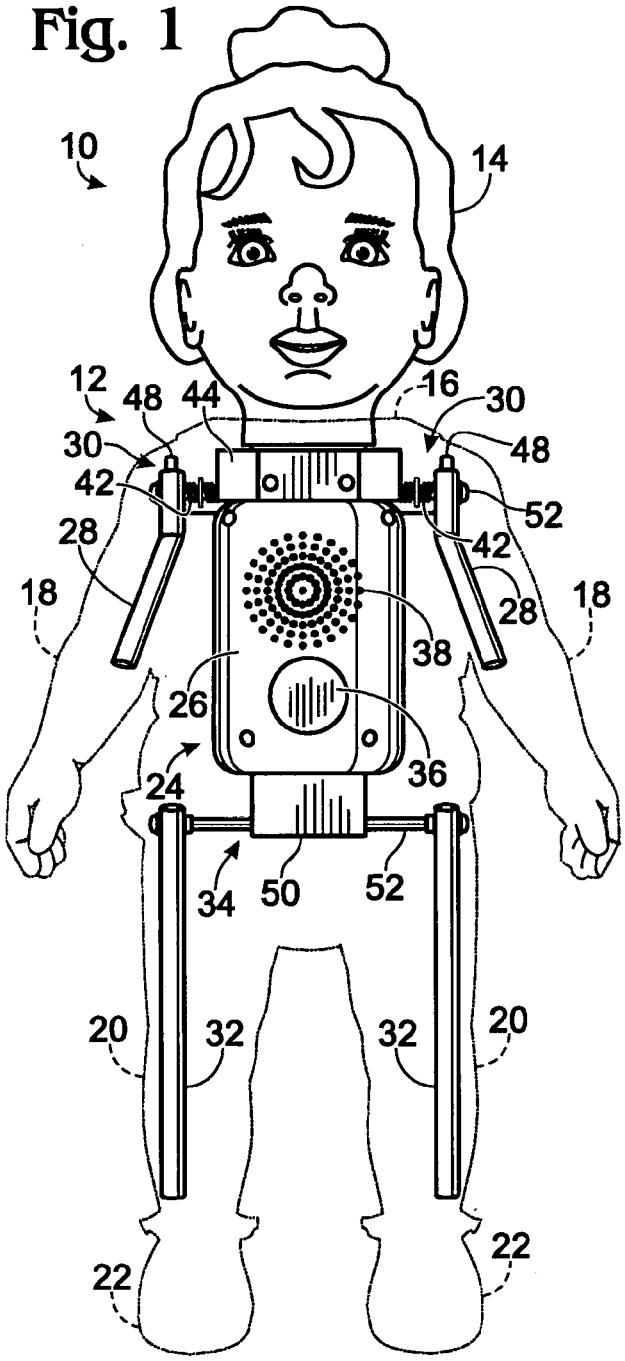
FIG. 1 is a front view of one embodiment of an assisted walking doll, indicating some external structure in dashed lines so that internal structure can be seen.
Figure 2:
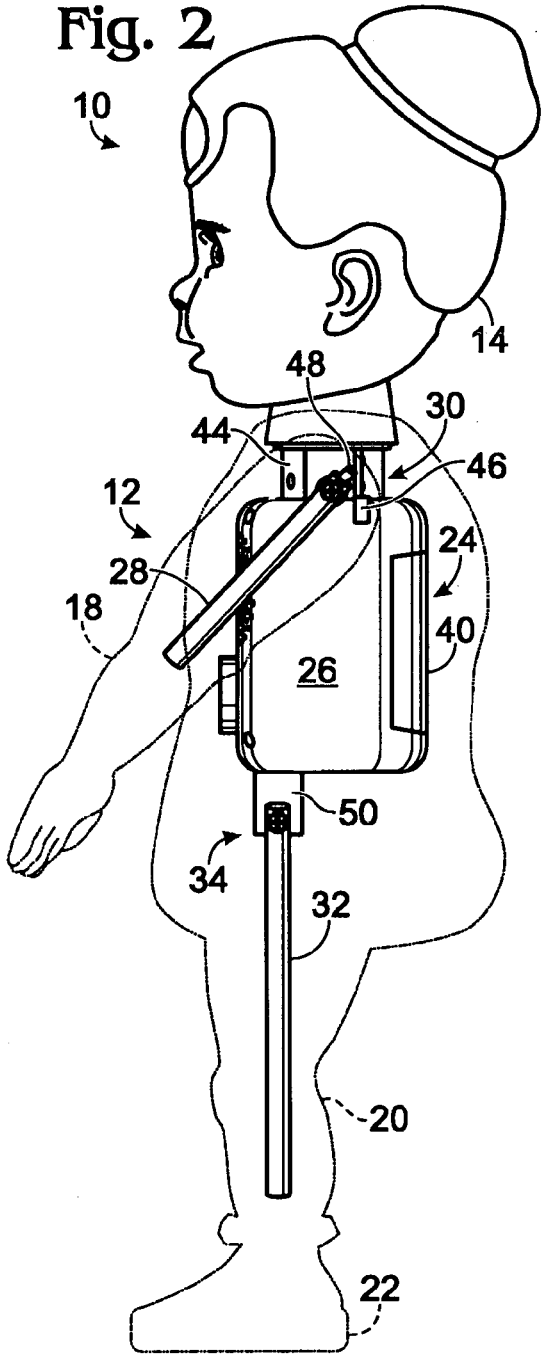
FIG. 2 is a side view of the doll of FIG. 1, with internal structure similarly indicated.

An exemplary embodiment of an assisted walking doll 10 is generally indicated in FIGS. 1 and 2. Doll 10 is shown to include a body 12 that is designed to resemble an infant toddler, but other embodiments may be designed to resemble other humanoid figures, animals, or objects. Body 12, shown partially in dashed lines, may include a head 14 at a top end of a torso 16. A pair of arms 18 may be attached to torso 16, one to a left side and one to a right side, below head 14. A pair of legs 20 may be attached, side-by-side in a left and right orientation, to a bottom end of torso 16. Feet 22 may be attached to the lower end of legs 20, completing body 12 of doll 10.

Body 12 may be formed of any suitable material or materials, such as a soft plastic exterior and a synthetic fiber stuffing, and may be supported by a skeletal structure 24, shown in solid lines. Skeletal structure 24 includes a torso housing 26, generally located within torso 16 and configured to support the torso. Skeletal structure 24 may also include joint members as appropriate for the doll, and joint assemblies to rotatably couple the joint members to the torso housing, such as to facilitate movement of different parts of the doll during play. Thus, in the illustrated embodiment, skeletal structure 24 includes arm members 28, configured to connect to torso housing 26 via shoulder-joint assemblies 30. Skeletal structure 24 also includes leg members 32, configured to connect to torso housing 26 via hip-joint assemblies 34.

Optionally, torso housing 26 may include a button 36 that may be used to actuate an audible response from doll 10 through an audio generator 38, such as a loud speaker. Compartment cover 40 may fit over an interior compartment (not shown) positioned within torso housing 26, which may provide space for a power supply. The interior compartment may store a power supply, such as one or more batteries, for powering the audio generator and any other electromechanical parts to facilitate any electromechanical functions that the doll may include. Examples of such electromechanical functions include activation of a predetermined output in response to a stimulus, such as the audio generator generating a sound effect when a user, such as a child, picks up the doll, or performs some other action during play.

Each shoulder-joint assembly 30 includes a pivot rod 42 (FIG. 1) to allow rotation of corresponding arm member 28 relative to torso housing 26. A pivot block 44 on torso housing 26 supports pivot rods 42 and couples the pivot rods to torso housing 26. A pair of pivot stops 46 (FIG. 2) extend from opposite sides of pivot block 44. Shoulder-joint assemblies 30 also each include a stop protrusion 48 that extends from an upper end of each arm member 28.

Stop protrusions 48 are positioned to selectively engage pivot stop 46, such as when arm member 26 is rotated. Thus, each shoulder-joint assembly may selectively prevent rotation of a corresponding arm member beyond a predetermined range of motion, for example when rotation of an arm member causes the stop protrusion to engage the corresponding pivot stop. As explained in more detail below, in the illustrated embodiment, shoulder-joint assemblies 30 are configured to prevent upward rotation of arm members 28 beyond the point at which the arm members are perpendicular to a vertical axis of the doll. In other words, when doll 10 is in an upright or vertical position relative to a ground surface, shoulder-joint assemblies prevent arm members 28 (and arms 18) from being rotated upward beyond a horizontal orientation.

By contrast, hip-joint assemblies 34 of the illustrated embodiment are not indicated to include a similar feature by which rotation of leg members 32 may be selectively limited, although other embodiments may include such a feature. Optionally, some embodiments may include any number of joint assemblies, one or more of which may include a feature by which rotation of a joint member may be selectively prevented. In the illustrated embodiment, however, hip-joint assemblies 34 are configured to allow relatively free rotation of leg members 32. A lower pivot block 50 supports lower pivot rods and couples the pivot rods to torso housing 26.

The configurations of the various joint assemblies in the doll of the illustrated embodiment may allow play patterns that enable a user, such as a child, to simulate teaching a toddler to walk. One such play pattern is illustrated in FIG. 3, in which doll 10 may be moved from a seated position through an intermediate position to a standing position, and then moved from the standing position in a simulated walking motion.

Figure 3:
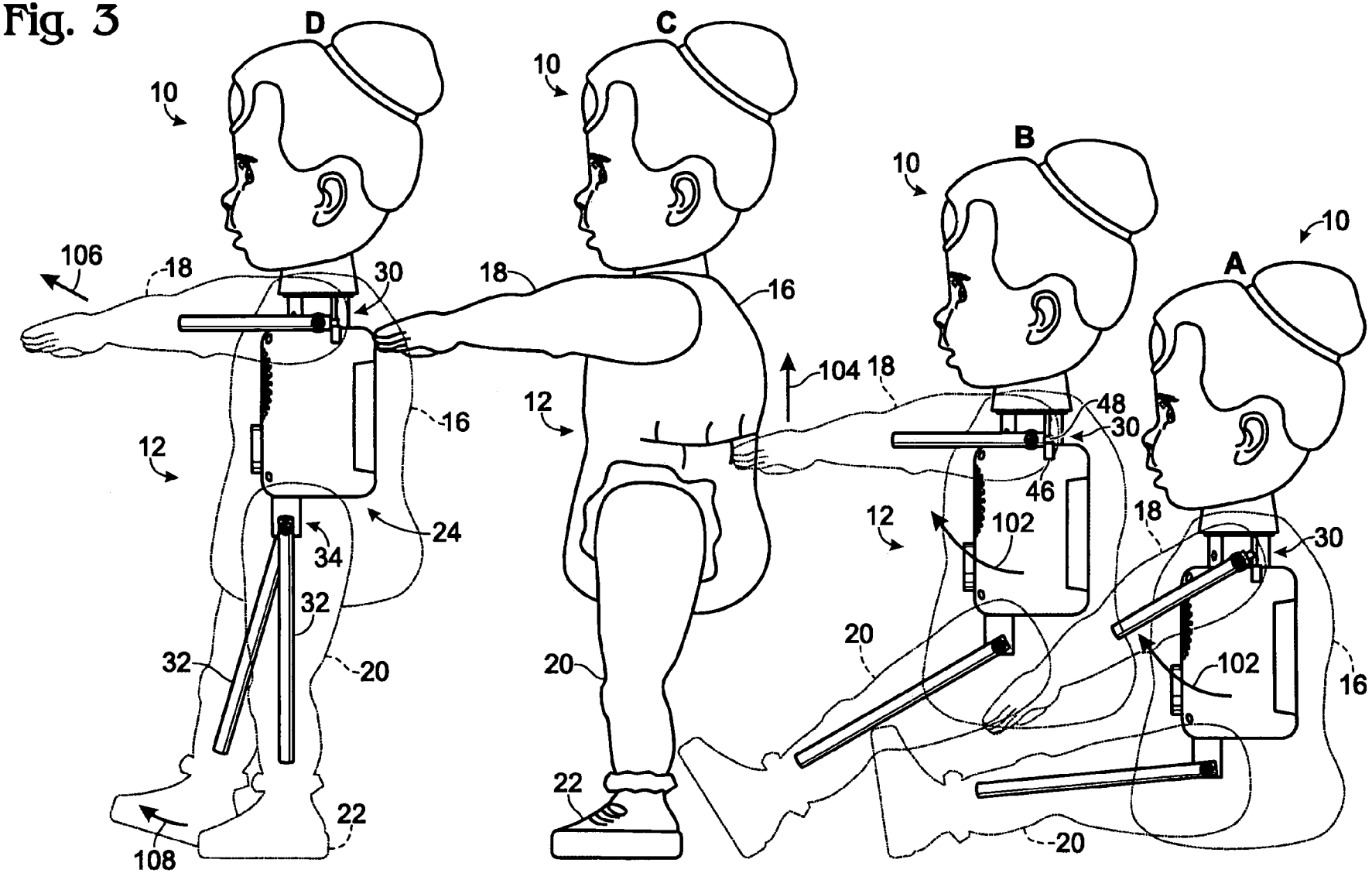
FIG. 3 is a side view of the doll of FIG. 1, illustrating a transition from a seated position to a walking position.

Referring to FIG. 3, doll 10 is shown in a seated position, which is indicated at A. In seated position A, which may be an at-rest position, legs 20 extend generally to the front of doll 10 as the doll "sits" on a ground surface. Arms 18 may extend generally to the front of, and downward from, shoulder-joint assemblies 30, for example resting in a position as dictated by gravity. Optionally, doll 10 may include biasing devices and/or other structure to urge one or more anatomical sections of the doll into a predetermined at-rest position. Torso 16 of doll 10 may be generally vertical when doll 10 is in seated position A.

Arms 18 may be elevated, as indicated by arrow 102, and positioned to raise doll 10 out of seated position A. For example, a user of doll 10 may grasp both of arms 18 and pull them up toward the front of doll 10. Rotating arms 18 upward and forward may prepare doll 10 to transition out of seated position A.

As explained above, once arms 18 are rotated to be generally parallel to the surface upon which doll 10 is seated, stop protrusions 48 engage pivot stops 46, preventing further upward rotation of arms 18. In such a position, with upward force applied to arms 18 urging stop protrusions 48 against pivot stops 46, shoulder-joint assemblies 30 are in a rigid configuration, which may enable continued upward force to raise the entire body 12 of the doll relative to the ground surface.

Thus, further upward force exerted on arms 18 may cause the doll to elevate into an intermediate position, indicated at B. In intermediate position B, weight transfers from the lower portion of the doll's torso to the legs and feet of the doll. In intermediate position B, legs 20 extend forward and downward from torso 16 and begin to support a portion of the weight of doll 10.

Arms 18 may remain generally parallel to the surface, as explained above. Thus, further upward force applied to arms 18, as indicated by arrow 104, causes doll 10 to transition to a standing position, indicated at C. Standing position C places doll 10 generally vertically. In standing position C, arms 18 may still extend horizontally forward from shoulder-joint assemblies 30. Legs 20 extend generally downward from torso 16. Legs 20 thus may generally support the weight of doll 10. Optionally, although not illustrated, doll 10 may be provided with a balancing system such as one or more internal counterweights, for example to allow the doll to remain in standing position C if external force is removed.

However, further forward and upward force, as indicated by arrow 106, applied in an alternating manner between left and right arms 18 of doll 10, may then cause the doll to "walk" forward, as indicated at D. During the walking motion shown at D, legs 20 extend generally downward from torso 16 and the weight of doll 10 shifts back and forth from one leg to the other.

The walking motion shown at D may result from interaction among force 106, leg members 32, and legs 20. As a user, for example a child, supports the doll through arms 18, the user may alternate application of force 106 between the left and right side of the doll. As a result, the doll may move forward in an alternating left and right motion, corresponding to alternating left and right side application of force 106.

As illustrated, the walking motion is caused by the interaction of force 106 with doll 10 as the doll's weight is shifted back and forth between left and right legs 20. For example, when the weight is shifted to the left leg, the inner material of the left leg between the left leg member and the outer surface of the left leg may be compressed, storing mechanical energy. When the weight is shifted off of the left leg to the right leg, the release of the stored mechanical energy may cause the left leg to swing forward, as indicated by arrow 108. This process may repeat when weight is shifted back to the left leg, causing the right leg to swing forward. The repetition of this process back and forth between left and right legs causes the doll to appear to "walk."

Optionally, such walking motion may be augmented or assisted by springs or other biasing members positioned at appropriate locations in or on the skeletal structure 24 of the doll, resiliency and/or other characteristics of the material chosen for the doll, a battery-powered or gear-driven motor, and so forth.

Figure 4:
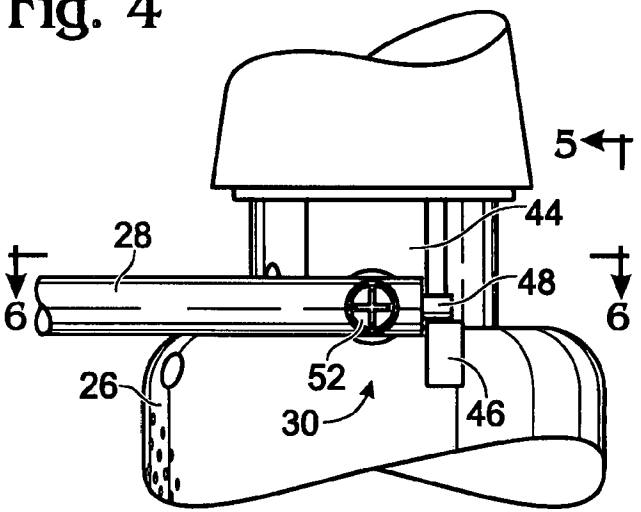
FIG. 4 is a detailed view of the shoulder assembly of the doll of FIG. 1.

As mentioned above, a joint assembly, such as shoulder-joint assembly 30, may selectively prevent rotation of a corresponding arm member beyond a predetermined range of motion. FIG. 4 shows a detailed side view of shoulder-joint assembly 30, as if seen from the left side of doll 10. Arm member 28 is prevented from extending past a generally horizontal orientation when upward rotation of the arm member causes stop protrusion 48 to engage pivot stop 46. However, the configuration of shoulder-joint assembly 30 may selectively permit further upward rotation of an arm member, such as by allowing stop protrusions 48 to bypass pivot stops 46 when the angle between each arm member 28 and corresponding pivot rod 42 is changed.

Figure 5:
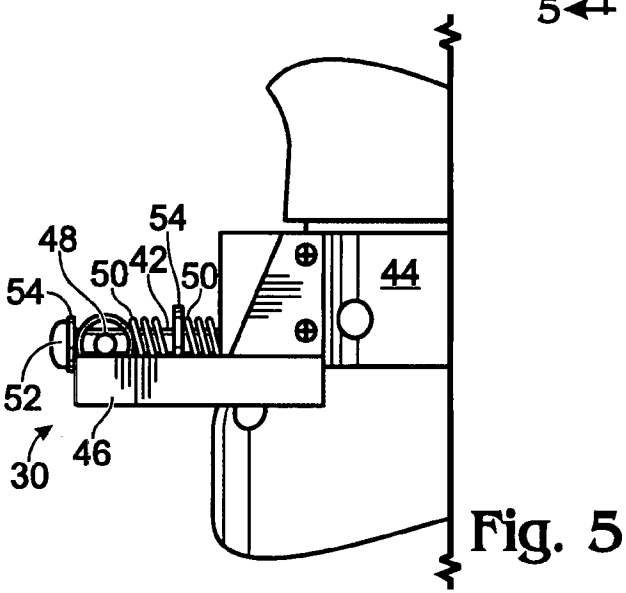
FIG. 5 is a detailed view taken along line 5-5 of the shoulder assembly of FIG. 4.

FIG. 5 shows a detailed shoulder-joint assembly 30 viewed from the back of doll 10. Two biasing members 50 urge each arm member 28 into a predetermined at-rest orientation relative to pivot rod 42 of shoulder-joint assembly 30, which is shown to be generally perpendicular to pivot rod 42. Retainer fastener 52 secures arm member 28 to pivot rod 42. An annular bearing 54 may separate retainer fastener 52 from arm member 28. Additional annular bearings 54 may be used to separate biasing members from adjacent biasing members or from the arm members.

Figure 6:
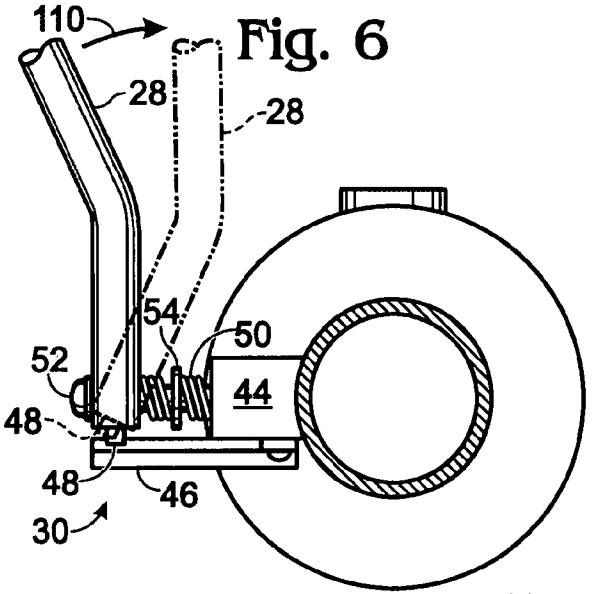
FIG. 6 is a detailed view taken along line 6-6 of the shoulder assembly of FIG. 4.

FIG. 6 is a detailed top view of a shoulder-joint assembly 30, and illustrates the movement of arm member 28 that may enable rotation upward past a generally horizontal position. At rest, biasing members 50 bias each arm member 28 into a predetermined at-rest position, shown in the illustrated embodiment to be approximately perpendicular to each pivot rod 42. In such a position, stop protrusions 48 are prevented from passing by pivot stops 46. However, the apertures (not shown) of each arm member 28 that receive pivot rod 42 may be sized to permit the angle relative to the pivot rod to be changed. The configuration of biasing members and the annular bearings on each pivot rod, as well as the size and shape of the aperture of the arm member, may allow the arm members to be moveable through a predetermined range of motion transverse to the plane of rotation of the arm member. For example, in the illustrated embodiment, arm members 28 may be angled inward or outward to permit stop protrusion 48 to bypass pivot stop 46, such as to allow arm members 28 to be rotated upward past a horizontal orientation.

This feature is illustrated in FIG. 6. Stop protrusion 48 of arm member 28 is shown to be engaging pivot stop 46, indicated in solid structure. In this configuration, further upward rotation of arm member 28 relative to the doll is selectively prevented. Applying a force (indicated by arrow 110) to angle arm member 28 inward (as indicated in dashed structure), allows stop protrusion 48 to correspondingly move outward and bypass pivot stop 46, allowing arm member 28 (and arm 18) to then be rotated upward beyond a horizontal orientation. Optionally, the aperture (not shown) and/or other components of should-joint assembly may allow outward angling of the arm member, and/or allow any other desired predetermined range of motion, to allow bypassing the pivot stop.

Figure 8:
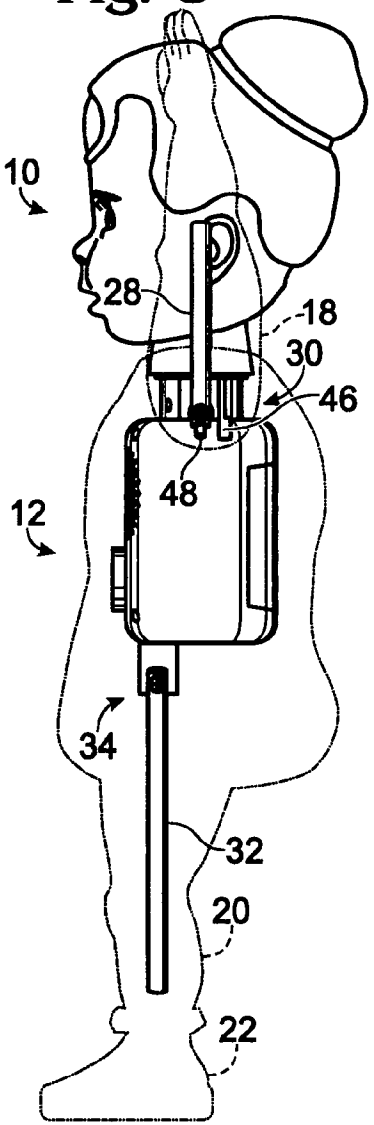
FIG. 8 is a side view of the doll of FIG. 1, with internal structure similarly indicated, and with the doll's arms in a raised configuration.
Figure 7:
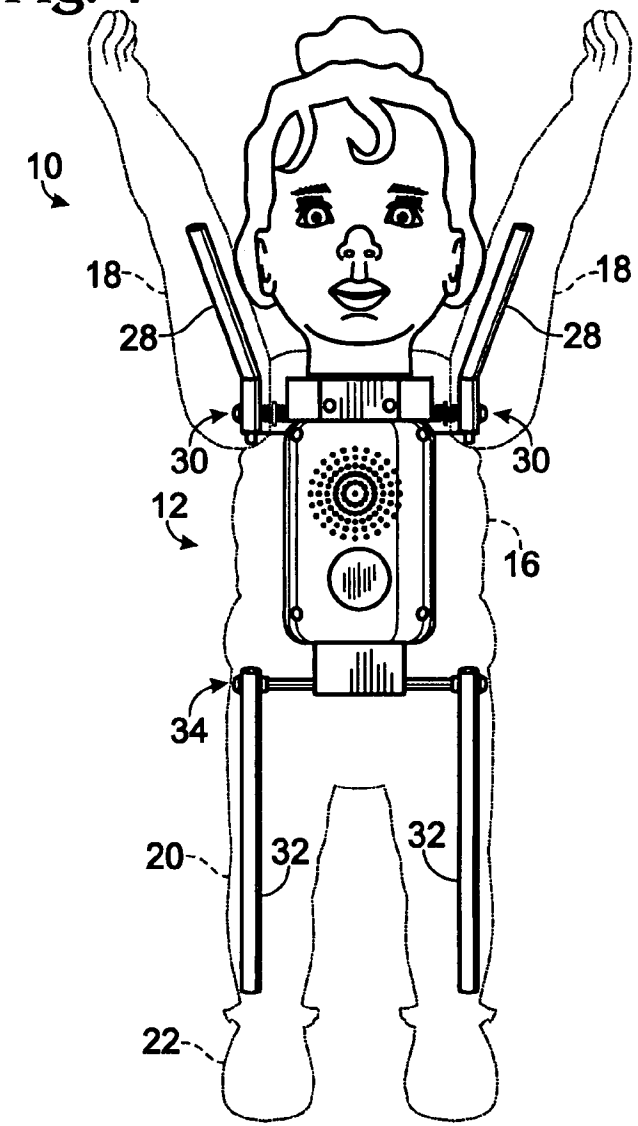
FIG. 7 is a front view of the doll of FIG. 1, with internal structure similarly indicated, and with the doll's arms in a raised configuration.

Allowing arm members 28 (and arms 18) to be raised beyond a horizontal orientation may allow play patterns additional to those described above. For example, once the doll is placed in a standing position (such as that indicated as C in FIG. 3), a user may desire to move the doll's arms further upward, for example as illustrated in FIGS. 7-8, in which arms 18 of doll 10 appear to be "reaching" straight upwards. Such a position may allow a user, such as a child, to simulate teaching a toddler to walk, for example by standing and positioning the doll between the child's legs while grasping arms 18, and "walking" the doll forward as the child walks forward.

Figure 10:
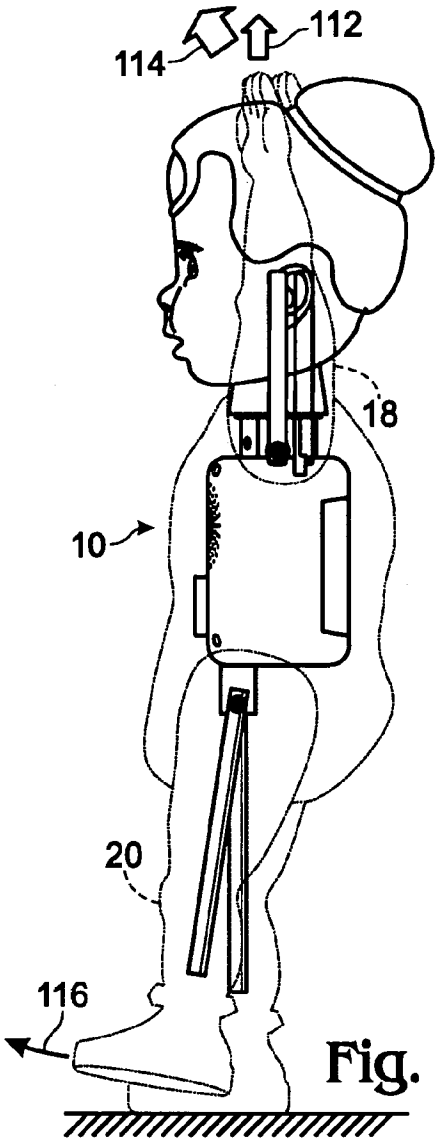
FIG. 10 is a side view of the doll of FIG. 1, illustrating the forces exerted on the doll's arms when the doll is being walked.
Figure 9:
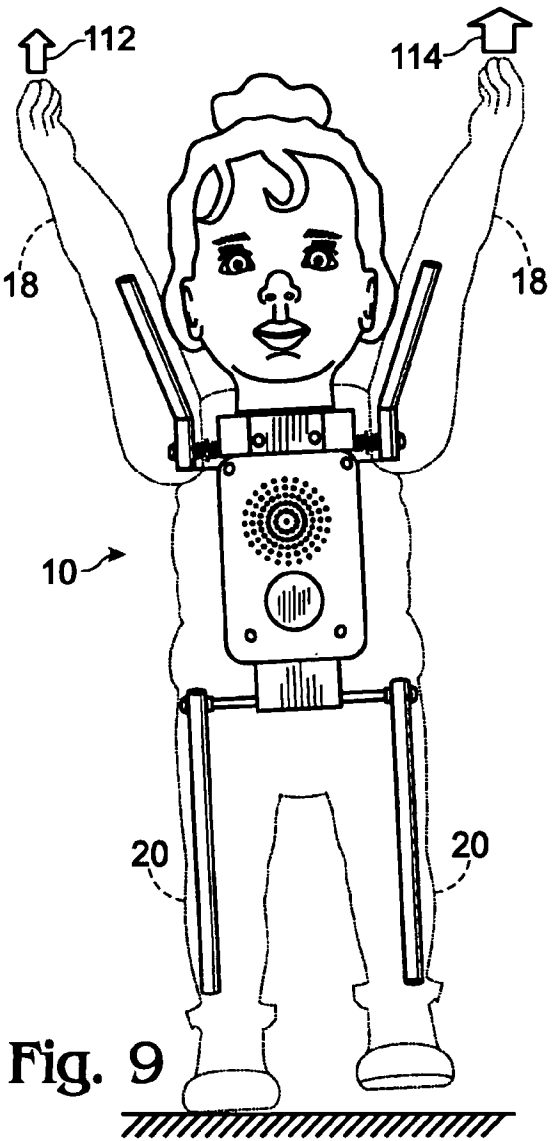
FIG. 9 is a front view of the doll of FIG. 1, illustrating the forces exerted on the doll's arms when the doll is being walked.

Such a walking motion is illustrated in FIGS. 9-10, in which doll 10 is in a standing position with arms 18 raised vertically. Doll 10 may simulate walking in this position when a user applies upward and forward forces, as indicated by force arrows 112 and 114, respectively. For example, a support force 112, or a vertical force, for holding doll 10 upright, may be applied to one arm, and a motive force 114 may be applied to the other arm, as illustrated. Motive force 114 may contain both a vertical component and a horizontal component. If the vertical component of motive force 114 is of greater magnitude than support force 112, the side of doll 10 corresponding to the arm to which motive force 114 is applied will elevate.

In a manner similar to that described above with respect to walking motion shown at D in FIG. 3, alternating motive force 114 and support force 112 between sides of doll 10 can simulate a walking motion. In FIGS. 9 and 10, the left side of doll 10 is raised by applying motive force 114 to left arm 18, and left leg 20 pivots forward, as indicated by arrow 116.

Figure 11:
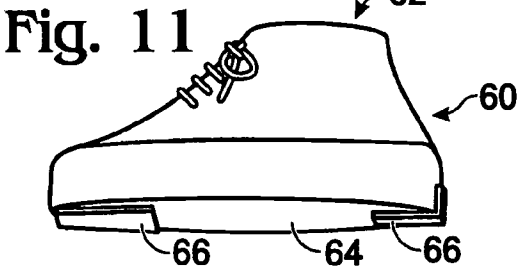
FIG. 11 is a detailed view of the shoes of the doll of FIG. 1.
Figure 12:
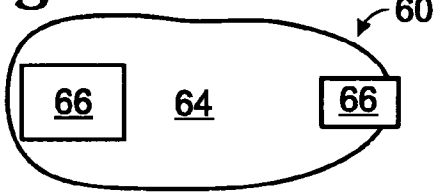
FIG. 12 is a detailed view of the shoes of the doll of FIG. 1.

Optionally, doll 10 may be provided with shoes or other structure to facilitate the simulated walking motion. FIGS. 11 and 12 illustrate a shoe 60 for use with doll 10. Shoe 60 may facilitate the simulated walking motion by providing traction to the foot of the leg that bears the weight of doll 10 and remaining in contact with the surface upon which the doll "walks." Shoe 60 includes an upper opening 62 for receiving a foot of doll 10, and a sole 64 for supporting the bottom of the doll's foot. Each sole 64 may include traction pads 66 configured to increase the coefficient of friction between shoe 60 and a surface across which the doll is "walked."

Traction pads 66 may be positioned near the toe and heel of shoe 60 so that increased friction occurs at both ends of the shoe. Placing the traction pads 66 at the toe and heel of shoe 60 may improve the "grip" of the shoes on a surface, as the doll is "walked." A traction pad placed near the toe of the shoe may hold the leg in place as the weight is being shifted from one leg to the other, before a leg swings forward, and a traction pad positioned near the heel of the shoe may allow the foot to grip the surface after the leg has swung forward and engaged the surface.

It is believed that the disclosure set forth herein encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element of the equivalent thereof, such claims should be understood to include incorporation of one or more such elements, neither requiring nor excluding two or more such elements.

It is believed that the following claims particularly point out certain combinations and subcombinations of features, functions, elements and/or properties that may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A joint assembly for use in a toy, comprising:

a pivot block including a pivot stop; and a joint member rotatably coupled to the pivot block with a pivot rod, the pivot rod including a biasing member configured to urge the joint member into a predetermined at-rest position relative to the pivot rod, and the joint member including a stop protrusion configured to engage the pivot stop upon rotation of the joint member in a predetermined direction;

wherein engagement of the pivot stop prevents further rotation of the joint member in a predetermined direction; and wherein the joint member is moveable through a predetermined range of motion transverse to the plane of rotation of the joint member, and wherein movement of the joint member transverse to the plane of rotation changes the position of the joint member relative to the pivot rod from the at-rest position and allows the stop protrusion to bypass the pivot stop.

2. The joint assembly of claim 1, wherein the predetermined at-rest position of the joint member is substantially perpendicular to the pivot rod.

3. The joint assembly of claim 1, wherein movement of the joint member transverse to the plane of rotation includes movement of the joint from the predetermined at-rest position relative to the pivot rod.

4. The joint assembly of claim 1, wherein the joint member includes an arm member.

5. The joint assembly of claim 1, wherein the joint member includes a leg member.

6. A joint assembly for use in a toy, comprising:

a pivot block;

a pivot rod extending from the pivot block;

a joint member rotatably coupled to the pivot rod;

a pivot stop extending from the pivot block; and a stop protrusion extending from the joint member configured to engage the pivot stop to prevent further rotation of the joint member in a predetermined direction;

wherein the pivot rod includes a biasing member configured to urge the joint member into a predetermined at-rest position relative to the pivot rod; and wherein the joint member is moveable through a predetermined range of motion transverse to the plane of rotation of the joint member, and wherein movement of the joint member transverse to the plane of rotation changes the position of the joint member relative to the pivot rod from the at-rest position and allows the stop protrusion to bypass the pivot stop.

* * * * *